US009924803B2

(12) United States Patent
Rodgers et al.

(10) Patent No.: US 9,924,803 B2
(45) Date of Patent: Mar. 27, 2018

(54) CORNER ASSEMBLY FOR A MODULAR BED FOUNDATION

(71) Applicants: Dennis L. Rodgers, Orange, CA (US); Chase T. Rodgers, Orange, CA (US)

(72) Inventors: Dennis L. Rodgers, Orange, CA (US); Chase T. Rodgers, Orange, CA (US)

(73) Assignee: Forever Foundations & Frame, LLC, Irvine, CA (US)

( * ) Notice: Subject to any disclaimer, the term of this patent is extended or adjusted under 35 U.S.C. 154(b) by 252 days.

(21) Appl. No.: 14/847,277

(22) Filed: Sep. 8, 2015

(65) Prior Publication Data

US 2017/0065091 A1 Mar. 9, 2017

(51) Int. Cl.
*A47C 19/00* (2006.01)
*A47C 19/02* (2006.01)

(52) U.S. Cl.
CPC ..... *A47C 19/005* (2013.01); *A47C 19/021* (2013.01); *A47C 19/024* (2013.01)

(58) Field of Classification Search
CPC ... A47C 19/005; A47C 17/645; A47C 23/005; A47C 19/021; A47C 19/024; F16B 12/44; F16B 12/58; F16B 12/60
See application file for complete search history.

(56) References Cited

U.S. PATENT DOCUMENTS 840,858 A * 1/1907 Merritt ..... F16B 12/58 5/289
846,409 A * 3/1907 Gaa ..... F16B 12/58 5/294
933,355 A * 9/1909 Adams ..... F16B 12/58 5/289
947,836 A * 2/1910 Merritt ..... F16B 12/58 5/289
3,109,180 A * 11/1963 Hyman ..... A47C 19/005 5/288
3,666,298 A * 5/1972 Reilly ..... A47B 47/0008 248/239
3,695,649 A * 10/1972 Laverone ..... F16B 7/04 403/173
3,822,423 A * 7/1974 Watts ..... A47C 19/005 297/440.13
4,734,946 A * 4/1988 Saputo ..... A47C 27/085 5/201
7,882,581 B2 2/2011 Felix et al.
7,937,788 B2 5/2011 Felix
(Continued)

*Primary Examiner* — Eric J Kurilla
(74) *Attorney, Agent, or Firm* — Morland C. Fischer

(57) ABSTRACT

A modular bed foundation to support the weight of a mattress and eliminate the need for a box spring. The bed foundation has a pair of end sections, a pair of side sections, and a plurality of horizontally extending mattress support slats detachably connected to the pair of side sections without the use of fasteners. First and second sets of legs are detachably connected to respective leg receivers at the pair of side sections without the use of fasteners. An improved corner assembly enables each of the pair of end sections to be detachably connected to an adjacent one of the pair of side sections without the use of fasteners. The improved corner assembly includes a corner post having a pair of corner inserts projecting therefrom to be slidably and removably received within hollow rails of one of the pair of end sections.

10 Claims, 2 Drawing Sheets

(56) References Cited

U.S. PATENT DOCUMENTS

| | | | | |
|---|---|---|---|---|
| 2005/0015884 | A1* | 1/2005 | Conaway | A47C 19/005 5/739 |
| 2008/0208709 | A1* | 8/2008 | Craver | A47C 19/005 705/26.8 |
| 2010/0154118 | A1* | 6/2010 | Pearce | A47C 19/021 5/201 |
| 2015/0086260 | A1* | 3/2015 | Turnipseed | F16B 12/44 403/205 |
| 2017/0055715 | A1* | 3/2017 | Rohr | A47C 19/005 |

* cited by examiner

CORNER ASSEMBLY FOR A MODULAR BED FOUNDATION

BACKGROUND OF THE INVENTION

1. Field of the Invention

This invention relates to a modular bed foundation of the kind used to support the weight of a mattress. The modular bed foundation of this invention eliminates the need for a box spring common to conventional bed frames. The modular bed foundation also has an improved square corner assembly and detachable legs by which the bed foundation can be efficiently assembled and disassembled without the use of fasteners or tools.

2. Background Art

Because the usual box spring of a bed and the mattress which lays thereon are often heavy and bulky, the typical bed frame which supports the weight of the box spring and the mattress is also usually heavy and bulky. The typical bed frame is commonly assembled for use or disassembled for storage or transport by using tools to install and remove fasteners which hold the foundation together. Having to install and remove the fasteners is often time consuming and requires some mechanical skill. When the bed frame is assembled or disassembled by the user, the process of setting up or breaking down the bed frame can sometimes prove to be a difficult and frustrating experience.

Accordingly, what would be preferable is the availability of a modular bed foundation having an improved corner assembly by which the number of components to be assembled or disassembled can be minimized and the assembly/disassembly process completed in an efficient manner without the use of fasteners and the tools required to install or remove the fasteners.

SUMMARY OF THE INVENTION

In general terms, a modular bed foundation is disclosed of the kind used to support the weight of a mattress. The bed foundation includes components which can be efficiently assembled or disassembled without the use of fasteners or the tools required to install and remove the fasteners. The bed foundation includes a pair of one-piece end sections which lie opposite one another and a pair of one-piece side sections which also lie opposite one another. Each of the pair of end sections is coupled to an adjacent one of the pair of side sections by means of an improved integral corner assembly without the addition of an intermediate corner member.

Each one-piece end section of the bed foundation includes upper and lower end rails and a series of end braces which extend therebetween to provide structural reinforcement. Each one-piece side section of the bed foundation includes upper and lower side rails and a series of side braces which extend therebetween to provide structural support. A plurality of parallel aligned mattress support struts having vertical tails at opposite ends thereof run horizontally across the bed foundation between the pair of side sections thereof to support the weight of a mattress. The vertical tails of the mattress support struts are removably received by respective slat tail receivers that are affixed to the side braces of each of the opposing pair of side sections. The mattress support struts extending across the foundation eliminate the need for a box spring to support the weight of the mattress. A number of legs of the bed foundation are removably received by respective hollow leg receivers that are affixed to each of the pair of side sections. In a preferred embodiment, each of the legs has an upstanding leg post that is surrounded by a locking collar. The locking collar is dimensioned to be pushed into frictional engagement with and retained by a leg receiver to hold the leg in place below the foundation and thereby hold the mattress of the ground.

The improved corner assembly which enables an efficient assembly or disassembly of the modular bed foundation includes a vertical corner post that is fixedly connected at one side thereof to the upper and lower side rails at one end of each of the pair of opposing side sections. A pair of corner inserts project outwardly from a different side of the corner post. The corner inserts are dimensioned to be slidably and removably received inwardly of respective hollow portions of the upper and lower end rails at one end of an adjacent one of the pair of opposing end sections. Thus, the adjacent end and side sections of the modular bed are joined directly to one another by the improved corner assembly without the use of fasteners to hold the foundation sections together.

DESCRIPTION OF THE PREFERRED EMBODIMENT

Figure 1:
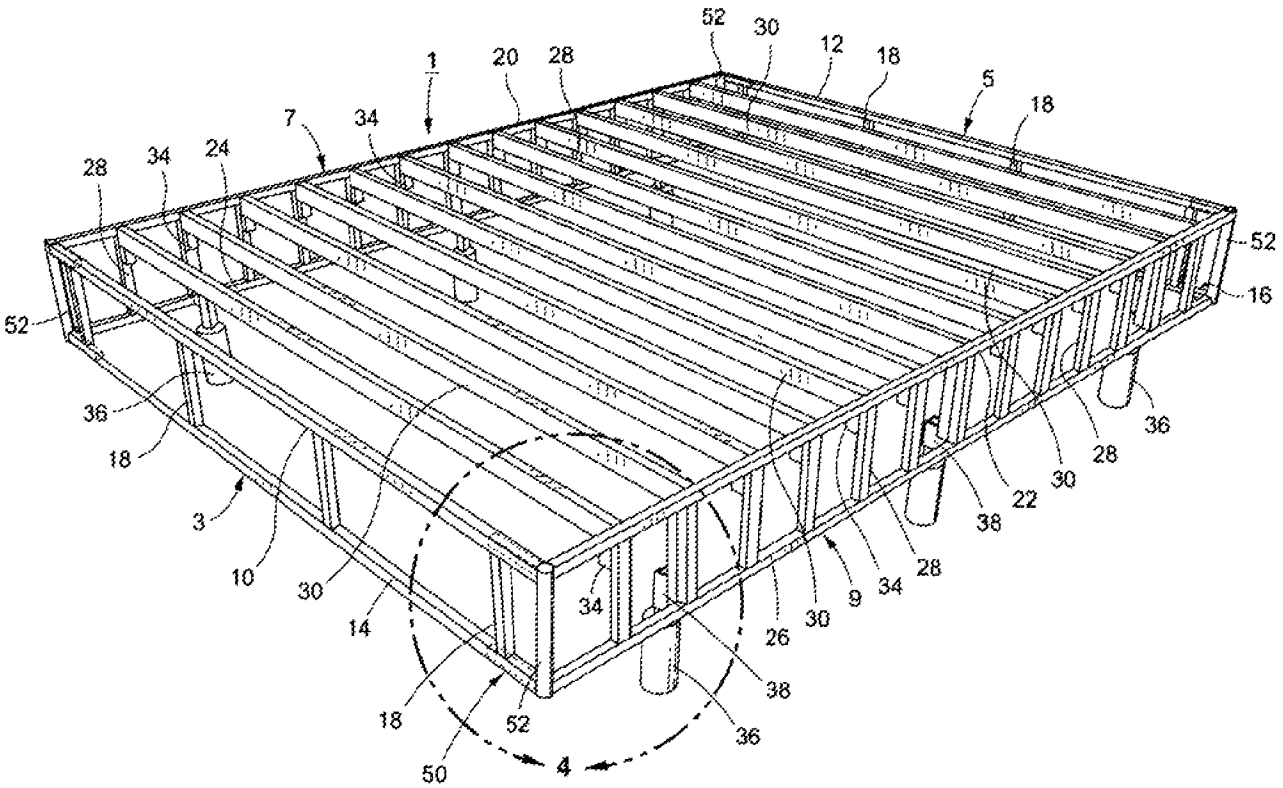
FIG. 1 is a perspective view of a modular bed foundation including improved corner assemblies according to a preferred embodiment of this invention.

A modular bed foundation 1 having an improved square corner assembly is initially described while referring to FIG. 1 of the drawings. The corner assembly which will be described in greater detail hereinafter enables the modular bed foundation 1 to be quickly and easily assembled and made ready for use. Moreover, the number of parts that are required to be packaged and shipped to users for assembly is advantageously minimized.

The modular bed foundation 1 is of the kind that is used to support a mattress above the ground to create a bed. The bed foundation 1 has a pair of one-piece end sections 3 and 5 which lie opposite one another at the ends of the bed foundation and a pair of one-piece side sections 7 and 9 which also lie opposite one another at the sides of the bed foundation. The end sections 3 and 5 and the side sections 7 and 9 are coupled to one another by means of the improved square corner assembly of this invention out the addition of any intermediate corner member and without the use of fasteners.

Each of the opposing end sections 3 and 5 has a respective upper end rail 10 and 12 which runs continuously therealong and a respective lower end rail 14 and 16 which also runs continuously therealong in spaced parallel alignment with the upper end rails 10 and 12. A series of vertical end braces 18 are connected (e.g., welded) between each of the upper end rails 10 and 12 and the lower end rails 14 and 16 of each of the end sections 3 and 5 of the bed foundation 1 to provide structural reinforcement.

Each of the opposing side sections 7 and 9 has a respective upper side rail 20 and 22 which runs continuously therealong and a respective lower side rail 24 and 26 which also runs continuously therealong in spaced parallel alignment with the upper side rails 20 and 22. A series of vertical side braces 28 are connected (e.g., welded) between each of the upper side rails 22 and 24 and the lower side rails 24 and 26 of each of the side sections 7 and 9 of the bed foundation 1 to provide additional structural reinforcement.

Figure 2:
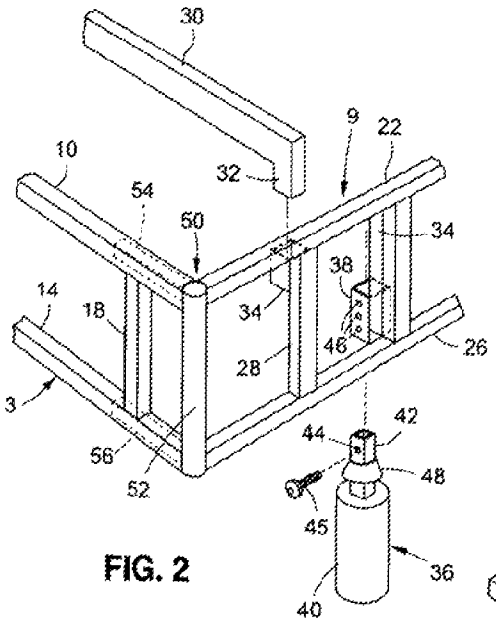
FIG. 2 is an exploded view showing a mattress support slat and a leg to be detachably connected to a side section of the modular bed foundation of FIG. 1.

Referring concurrently now to FIGS. 1-4 of the drawings, a plurality of spaced, parallel aligned mattress support slats 30 extend horizontally across the bed foundation between the upper side rails 20 and 22 of the side sections 7 and 9. As is best shown in FIG. 2, each box spring support slat 30 has a short vertical tail 32 extending downwardly from each end thereof. A hollow slat tail receiver 34 is affixed (e.g., welded) to the top of each vertical side brace 28 of each of the side sections 7 and 9. The plurality of mattress support slats 30 are held in place between the side sections 7 and 9 of bed foundation 1 without the use of fasteners when each of the tails 32 thereof is pushed downwardly so as to be removably received and surrounded by a respective hollow slat tail receiver 34. With the slats 30 held in place and running horizontally across the bed foundation 1 in the manner shown in FIG. 1, a conventional fabric deck (not shown) is attached to the slats over which a typical mattress (also not shown) is laid. By virtue of the mattress support slats 30 extending across the foundation 1, the need for a box spring and the weight associated therewith are advantageously eliminated.

The modular bed foundation 1 can either be laid flat against a floor or held above the floor. In the case where it is desirable for the bed foundation 1 to be held off the floor, a number of (e.g., three) legs 36 are coupled to the lower side rail 24 and 26 of each of the side sections 7 and 9. The number of legs can vary with the size of the bed foundation and the weight of the mattress to be laid thereon. A number of hollow leg receivers 38 (only one of which being shown in FIG. 2) are affixed (e.g., welded) to the inside of respective vertical side braces 28 of each of the side sections 7 and 9. The leg receivers 38 are located immediately above the lower side rails 24 and 26 of the side sections 7 and 9. The number of leg receivers 38 preferably corresponds to the number of legs 36 that hold the bed foundation 1 off the floor.

Each leg 36 of the bed foundation includes a cylindrical) base 40 and a post 42 standing upwardly from the base 40. According to one embodiment, a hole 44 is formed through the leg post 42 to receive a fastener 45 therethrough. That is, the upstanding leg post 42 of each leg 36 is pushed upwardly so as to be removably received and surrounded by a hollow leg receiver 38 (best shown in FIG. 4). The hole 44 through the leg post 42 is axially aligned with one of a series of holes 46 formed through the leg receiver 38. The fastener 45 is inserted through the axially aligned holes 44 and 46 to hold the upstanding post 42 in place within the hollow leg receiver 38 and thereby prevent a detachment of the leg 36 from the bed foundation. The particular hole 46 of the leg receiver 38 through which the fastener 45 is inserted allows the elevation of the bed foundation above the floor to be selectively adjusted.

In the alternative, to avoid the use of fasteners (e.g., like that designated 45 in FIG. 2) otherwise required to connect the legs 36 to respective leg receivers 38, a locking collar 48 (best shown in FIG. 2) can be located around the upstanding kg post 42. In this case, when the leg post 42 is pushed upwardly for receipt by a hollow leg receiver 38, the locking collar 48 will be frictionally engaged by and retained within the leg receiver. To this end, the leg receivers 38 can flare outwardly and the locking collars tapered so as to be wedged into locking engagement with the leg receivers.

Figure 3:
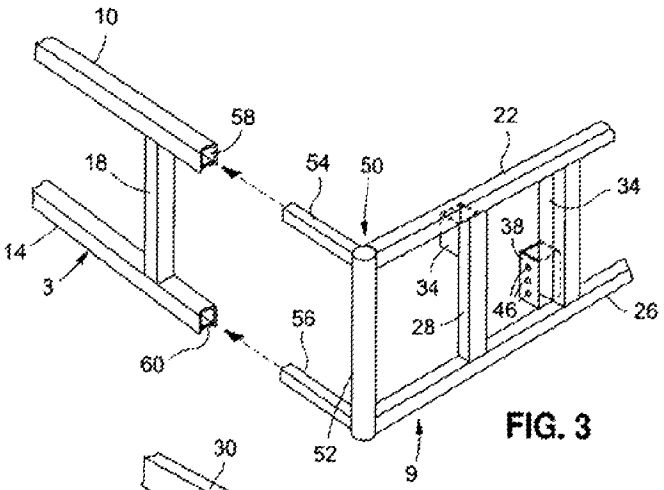
FIG. 3 is an exploded view showing adjacent end and side sections of the modular bed foundation of FIG. 1 to be detachably coupled to one another by means of the improved corner assembly of this invention.
Figure 4:
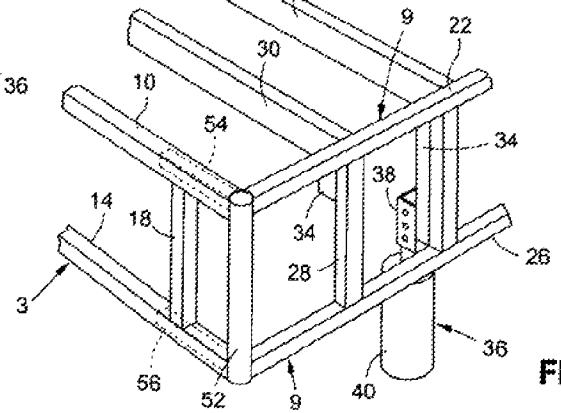
FIG. 4 is an enlarged detail taken from FIG. 1 showing the adjacent end and side sections coupled together at one corner of the bed foundation by means of the improved corner assembly.

Referring specifically to FIGS. 2-4 of the drawings, details are now disclosed of the square corner assemblies by which to facilitate the connection of the end sections 3 and 5 of the bed foundation 1 to adjacent side sections 7 and 9. Each corner assembly 50 is located at one corner of the bed foundation 1. Since all of the corner assemblies are identical, only the corner assembly 50 shown at FIGS. 2-4 will be described.

The corner assembly 50 includes a vertical corner post 52 that lies at the intersection of the end section 3 with the side section 9. One end of the upper side rail 22 from the side section 9 is affixed (e.g., welded) to the top at one side of the corner post 50, and one end of the lower side rail 26 from the same side section 9 is affixed to the bottom of the corner post. As is best shown in FIG. 3, a first corner insert 54 is affixed (e.g., welded) to and projects outwardly from the top of a different side of the corner post 50, and a second corner insert 56 is affixed to and projects outwardly from the bottom of the corner post. The first and second corner inserts 54 and 56 extend in perpendicular alignment with the upper and lower side rails 22 and 26 of the side section 9.

As is also best shown in FIG. 3, at least some portion 58 and 60 of each of the upper and lower end rails 10 and 14 of the end section 3 is hollow. The hollow portions 58 and 60 of the upper and lower end rails 10 and 14 must be suitably dimensioned to accommodate therewithin respective ones of the first and second corner inserts 54 and 56 that project from the corner post 52 of the corner assembly 50. In particular, and as is best shown in FIG. 4, the end section 3 is joined to its adjacent side section 9 when the first and second corner inserts 54 and 56 are slidably and removably received within the hollow portions 58 and 60 of the upper and tower end rails 10 and 14 of the end section 3.

The first and second corner inserts 54 and 56 must be of sufficient length so as to be retained in place by respective ones of the upper and lower end rails 10 and 14 without the use of fasteners. In this same regard, the first and second corner inserts 54 and 56 can also be quickly and easily pulled outwardly and removed from the upper and lower end rails 10 and 14 to enable the separation of the end section 3 from its adjacent side section 9 whenever it is necessary to disassemble the modular bed foundation 1 of FIG. 1.

By virtue of the improved square corner assembly 50 of this invention, the end sections 3 and 5 can be detachably connected directly to adjacent side sections 7 and 9 without any additional intermediate corner members, whereby the number of components necessary to assemble the bed foundation is minimized. Moreover, each of the corner assemblies 50 is retained between adjacent end and side sections without the use of fasteners which conveniently avoids the need for tools and the time and skill required to use them. Accordingly, the corner assembly 50 herein disclosed enables the modular bed foundation 1 of FIG. 1 to be more efficiently assembled and disassembled.

The invention claimed is:

1. A modular bed foundation comprising:

a pair of end sections positioned opposite one another;

a pair of side sections positioned opposite one another, each end section from said pair of end sections lying adjacent one side section from said pair of side sections;

a corner assembly located between one of said pair of end sections and an adjacent one of said pair of side sections so as to hold said end and side sections together, said corner assembly being detachably connected to at least one of said adjacent end and side sections; and a first set of legs detachably connected to one of said pair of side sections and a second set of legs detachably connected to the other one of said pair of side sections, wherein each leg of said first and second sets of legs has a base to support the weight of said bed foundation above the around and a leg post standing upwardly from said base, and wherein each of said pair of side sections has a set of hollow leg receivers attached thereto, the upstanding leg post of one leg of said first and second sets of legs being slidably and removably received by a corresponding one hollow leg receiver of the sets of hollow leg receivers by which said one leg is detachably connected to one of said pair of side sections.

2. The modular bed foundation recited in claim 1, wherein said corner assembly is fixedly connected to the other one of said adjacent end and side sections.

3. The modular bed foundation recited in claim 1, wherein said corner assembly includes a corner post lying at the intersection of the one of said pair of end sections and the adjacent one of said pair of side sections, said corner post being detachably connected to the at least one of said adjacent end and side sections.

4. The modular bed foundation recited in claim 3, wherein the corner post of said corner assembly includes a corner insert projecting therefrom, and wherein the one of said adjacent end and side sections to which said corner post is detachably connected having a hollow rail extending therealong, said corner insert being slidably and removably received within said hollow rail so that said adjacent end and side sections are connected to one another without the use of fasteners.

5. The modular bed foundation recited in claim 3, wherein the corner post of said corner assembly includes first and second inserts projecting from one side thereof, and wherein the one of said adjacent end and side sections to which said corner post is detachably connected having first and section hollow rails located one above the other, said first and second corner inserts being slidably and removably received within respective ones of said first and second hollow rails so that said adjacent end and side sections are connected to one another without the use of fasteners.

6. The modular bed foundation recited in claim 5, wherein a different side of the corner post of said corner assembly is fixedly connected to the other one of said adjacent end and side sections.

7. The modular bed foundation recited in claim 1, wherein there is a tapered locking collar surrounding the upstanding leg post of the one leg of said first and second sets of legs, said locking collar being retained in frictional engagement with the one hollow leg receiver of the sets of hollow leg receivers when the upstanding leg post of said one leg is slidably and removably received by said one hollow leg receiver so that said one leg is detachably connected to the one of said pair of side sections.

8. The modular bed foundation recited in claim 1, wherein there is a first hole formed in the upstanding leg post of the one leg of said first and second sets of legs, and there is a second hole formed in the one hollow leg receiver of the sets of hollow leg receivers, said first and second holes being axially aligned with one another to receive a fastener therethrough when the upstanding leg post of said one leg is slidably and removably received by said one hollow leg receiver by which said one leg is detachably connected to the one of said pair of side sections.

9. A modular bed foundation comprising:

a pair of end sections positioned opposite one another;

a pair of side sections positioned opposite one another, each end section from said pair of end sections lying adjacent one side section from said pair of side sections; and a corner assembly including a corner post located at the intersection of one of said pair of end sections and an adjacent one of said pair of side sections, wherein said corner post is fixedly connected to one of said pair of side or end sections while also being detachably connected to the the adjacent other one of said pair of side or end sections, said corner post including upper and lower inserts projecting therefrom, and wherein the adjacent other one of said pair of side or end sections comprises a pair of rails extending therealong and including hollow ends, such that the upper and lower inserts which project from said corner post are slidable into and removably received by respective ones of the hollow ends of the pair of rails of the adjacent other one of said pair of side or end sections, whereby the adjacent end and side sections of said modular bed foundation are detachably connected end-to-end to one another without the use of fasteners.

10. The modular bed foundation recited in claim 9, further comprising a plurality of mattress support slats extending horizontally between and detachably connected at opposite ends thereof to said pair of side sections without the use of fasteners.

* * * * *